United States Patent [19]

Fields

[11] Patent Number: 4,797,793

[45] Date of Patent: Jan. 10, 1989

[54] HEADBAND FOR HOLDING A FLASHLIGHT

[76] Inventor: Tom R. Fields, 5714 Verner Oak Ct., Sacramento, Calif. 95841

[21] Appl. No.: 159,676

[22] Filed: Feb. 24, 1988

[51] Int. Cl.[4] ..... F21L 15/14

[52] U.S. Cl. ..... 362/105; 362/191; 2/209.2; 224/181

[58] Field of Search ..... 2/209.2, DIG. 11; 224/181, 250; 362/105, 190, 191, 382, 804

[56] References Cited

U.S. PATENT DOCUMENTS 4,462,064 7/1984 Schweitzer ..... 362/191 X 4,718,126 1/1988 Slay ..... 362/105 X 4,729,499 3/1988 Martin ..... 224/181

*Primary Examiner*—Stephen F. Husar

*Attorney, Agent, or Firm*—Thomas M. Freiburger

[57] ABSTRACT

A headband of elastic material has a pocket for receiving the barrel of a flashlight, particularly the type which permits focusing of the light beam. In accordance with the preferred construction, the flashlight pocket is formed by an overlap of the two ends of the headband strap, where it is joined together by stitching. The stitching is at the edges, leaving an open ended pocket oriented in the forward direction.

9 Claims, 1 Drawing Sheet

HEADBAND FOR HOLDING A FLASHLIGHT

BACKGROUND OF THE INVENTION

The invention is in the general field of wearing apparel for holding tools, and is particularly concerned with a headband for retaining a flashlight on the head, for projecting a light beam forwardly.

A number of different headband-mounted flashlights and headbands for retaining flashlights have been known. For example, see U.S. Pat. Nos. 4,360,930 and 4,462,064. These patents disclosed headband devices for holding flashlights along the side of the head. The latter patent showed a pre-formed, relatively rigid tube for receiving the of a flashlight, while the former Patent was concerned with a flexible headband strap whch could be wrapped around the flashlight when not in use.

Other headband/flashlight devices have included elastic headbands permanently attached to a lamp and battery pack, which engaged centrally against the forehead, without any barrel-tyPe battery compartment. In these, the lamp was generally in the position of a miner's headlamp, and the aim of the lamp was sometimes pivotable to higher or lower positions.

None of these prior headlamp retaining arrangements was as simple in construction, versatile in application and use, and as efficient as the flashlight retaining headband of the present invention described below.

SUMMARY OF THE INVENTION

In accordance with the present invention, a headband is provided for wearing around the head, above the ears, along the temples and across the forehead. The headband is elastic and of a material which engages comfortably against the head, and fits a range of user sizes.

The headband of the invention receives flashlight of the contemporary type having a flashlight retaining barrel relatively small in diameter, such as for retaining two Size AA or Size AAA dry cells. Such flashlights (such as marketed under the trademark "MAG") generally have an enlarged front or lamp end and a means for adjusting the focus of the beam. The width of the headband of the invention is sufficient as to form a pocket which snugly receives the barrel of such a flashlight with two layers of the headband material seamed together along their side edges. The width of the band is also important for wearer comfort and retention on the head.

The pocket is very simply formed by an overlap in the two ends of the length of the headband material. The overlap is approximately the length of (or somewhat shorter than) the bat- tery-retaining barrel of the flashlight to be held. The overlap area is stitched or otherwise secured so as to snugly receive a flashlight in the pocket. However, the headband material may optionally be elastic in the transverse direction as well as in the longitudinal direction so as to expand the headband slightly in the transverse direction to firmly grip the flashlight when it is inserted into the pocket.

It is therefore among the objects of the present invention to improve over prior headband flashlight devices and to provide a flashlight holding band device which is simple in construction and operation, and versatile in accommodating a variety of head sizes with comfort to the user. These and other objects, advantages and features of the invention will be apparent from the following description of a preferred embodiment, considered along with the accompanying drawings.

DESCRIPTION OF PREFERRED EMBODIMENTS

Figure 1:
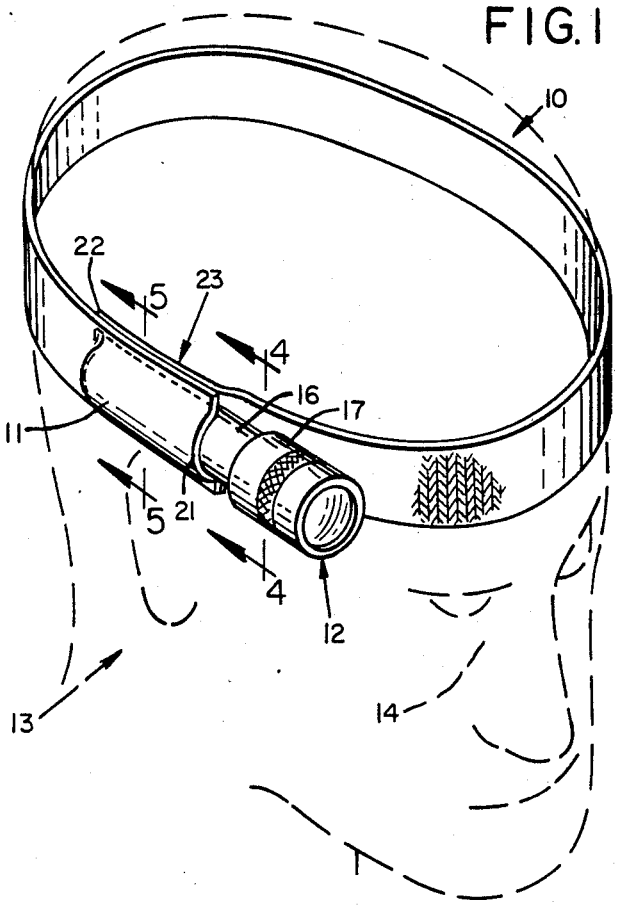
FIG. 1 is a perspective view showing a flashlight retaining headband in accordance with the invention as worn on a user's head, and showing a flashlight held in a pocket of the headband.

In the drawings, FIG. 1 shows a headband 10 according to the invention, retaining in a pocket or sleeve 11 a flashlight 12. The headband 10 is positioned on the head of a user 13 such that the flashlight lies generally alongside the user's temple and projects a light beam forwardly in the general direction of view of the user.

The flashlight 12 may be any of several types having a relatively small-diameter barrel 16 or cylindrical portion within which a battery of cells is held. The battery cells may be Size AAA or Size AA or even Size C, so that the cylindrical flashlight casing Portion or barrel 16 is just slightly larger in diameter than the battery. For example, the flashlight may be of the type having an enlarged lamp end 17 which is rotatable to permit focusing of the light beam (such as the type sold under the trademark "MAG"). Such flashlights generally have a barrel 16 sized to receive two AA battery cells or two AAA battery cells.

The headband 10 preferably is formed of a strap of elastic material, such as an elastic belting material made by Streamline Industries of Garen City, N.Y. This material is elastically stretchable essentially only lengthwise, and a belting material which is stretchable both lengthwise and transversely may be used if desired. The preferred material may include rubber, some synthetic fibers and some cotton fibers. The presence of cotton enables the headband 10 to serve as a sweat band as well as a holder for a flashlight.

Alternatively, a non-elastic flexible strap which accommodates some degree of head size adjustment in another way, and which fits closely and grips the flashlight barrel 16 in the pocket 11, is also contemplated within the present invention.

The preferred elastic strap material accommodates a range of different head sizes with comfort, while also forming the Pocket 11 to receive the flashlight snugly and grip it dependably. As shown in FIG. 1, the flashlight is Positioned by the headband device 10 of the invention alongside the temple area of the user's head, a relatively flat region of the head which avoids discomfort from the flashlight.

Figure 2:
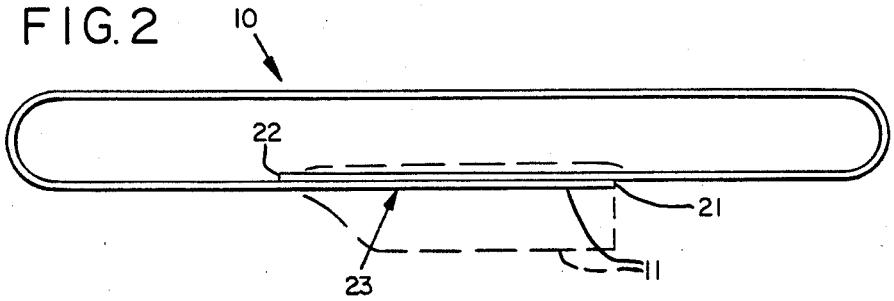
FIG. 2 is a plan view of the headband (removed from the head of the user), indicating the flashlight pocket both in flat configuration and in stretched confirmation (dashed lines) as when holding a flashlight.
Figure 3:
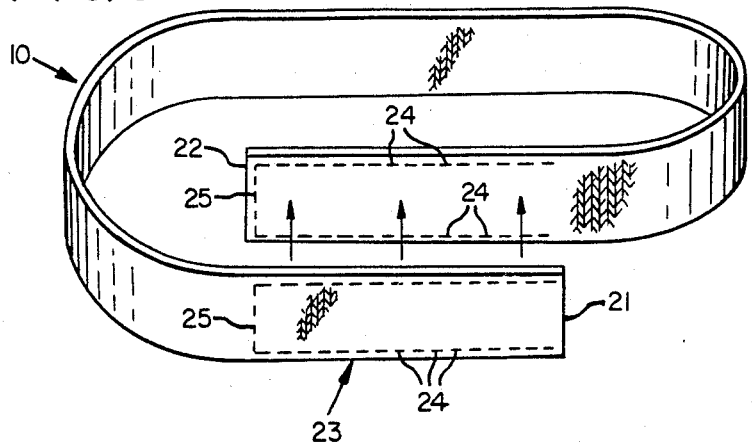
FIG. 3 is a perspective view indicating the manner of construction of the headband in accordance with the invention.

FIGS. 2 through 5 illustrate the preferred construction of the flashlight-retaining headband 10 in accordance with the invention, with FIG. 3 indicating assembly and stitching. The strap material from which the headband is formed has two ends 21 and 22, which are connected in an overlap area 23. The band is in two layers in this overlap area, connected together at or near the side edges of the strap material (FIG. 3) to form the pocket 11 between them. In this preferred embodiment the connection is by stitching 24. At the rear of the pocket, stitching 25 may be used to secure the layers together, but it is not necessary to close the pocket at the rear and in some circumstances it may be more advantageous that it be left open.

In any event, the strap end 21 must be on the outside of the headband, at the forward end of the pocket, to accommodate the flashlight. If the rearward end 22 is left unstitched, the headband can be inside-out reversible, with different colors, for example, on either side.

FIG. 2 shows the headband 10 unstretched and without a flashlight, but also shows in dashed lines the pocket generally as it would be configured when holding a flashlight.

Figure 4:
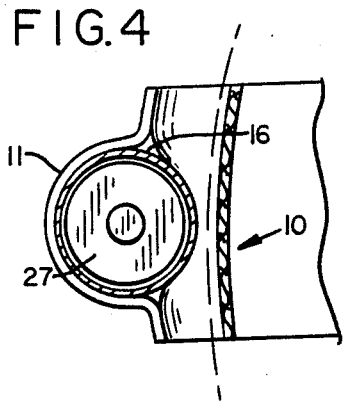
FIG. 4 is a sectional view through the headband showing features of construction of the pocket for retaining the flashlight, as seen along the line 4—4 in FIG. 1.
Figure 5:
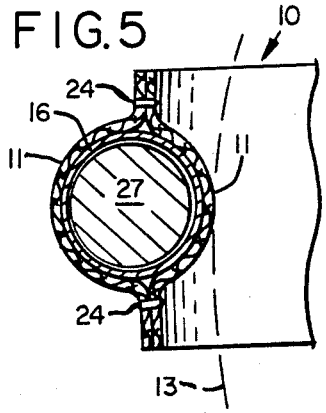
FIG. 5 is a sectional view further illustrating construction of the flashlight holding pocket, as seen along the line 5—5 in FIG. 1.

FIGS. 4 and 5 are sectional views through the flashlight and headband showing battery cells 27 in the flashlight casing 16, and showing the configuration of the flashlight pocket at different points. FIG. 5 shows the stitching 24 preferably used to hold the band together and form the pocket.

It should be understood that although the headband material preferably is elastic and stretchable longitudinally in the preferred embodiment of the invention, the invention also encompasses a flexible but non-stretchable headband strap having some form of adjustment to accommodate different head sizes, and with a pocket which fits snugly over the flashlight for which it is intended, so that it can be gripped securely. The preferred pocket construction of the invention provides for efficient headband manufacture and enables the pocket size to be closely controlled.

The above described prefered embodiments are intended to illustrate the principles of the invention, but not to limit its scope. Other embodiments and variations to these preferred embodiments will be apparent to those skilled in the art and may be made without departing from the scope of the invention as defined in the following claims.

I claim:

1. A headband wearable on the head of a user, for retaining a flashlight adjacent to the user's temple and oriented to project a light beam in a forward direction generally in the direction the user is facing, comprising:

a band of elastic, stretchable material formed generally into a loop sized to fit about a user's head when stretched, the band being formed from a strap of material having two ends, with the ends being overlapped by an overlap distance of sufficient length generally to accommodate the length of a cylindrical portion of a flashlight, the overlapped portion of the band being secured along edges of the two layers of strap so as to form a pocket between the two layers, open at a forward end, with an outer layer of the strap being at the forward end of the overlapped portion, and the width of the strap of material being sufficient to accommodate in the pocket a cylindrical portion of a flashlight.

2. The flashlight retaining headband device of claim 1, wherein the headband width and the pocket size are such as to receive the cylindrical Portion of a flashlight containing Size AA batteries.

3. The flashlight retaining headband device of claim 1, wherein the overlapped portion of the headband is secured together at the rearward end of the overlap, the pocket being open only at the forward end of the overlap.

4. The flashlight retaining headband device of claim 1, wherein the headband is about one inch in width.

5. The flashlight retaining headband device of claim 1, wherein the edges of the two layers of strap material in the overlapped portion are held together by stitching.

6. The flashlight retaining headband of claim 1, wherein the band of elastic material has elasticity in the transverse direction as well as in the longitudinal direction, so that the flashlight upon being inserted can elastically stretch the pocket so as to tightly grip the flashlight in the pocket.

7. A headband for retaining a generally cylindrical flashlight on the side of a user's head, with the flashlight oriented to Project a light beam in a forward direction generally in the direction of view of the user, comprising:

a band of flexible material formed generally into a loop sized to fit about a user's head, with means for adjusting the length of the headband to accommodate different user head sizes, the band being formed from a strap of material having two ends, with the ends overlapped into two layers through an overlap distance of sufficient length generally to accommodate the length of a cylindrical portion of a flashlight, the overlapped portion of the band being secured along edges of the two layers so as to form a pocket between the two layers, open at a forward end, with an outer layer of the strap being at the forward end of the overlapped portion, and the width of the strap of material being sufficient to accommodate closely in the pocket a cylindrical portion of the flashlight.

8. A headband as in claim 7, wherein the means for adjusting the length comprises stretch means enabling the band to stretch in the longitudinal direction.

9. A headband as in claim 7, wherein the band of flexible material includes a content of cotton fibers, whereby te headband acts as a sweatband as well as flashlight retaining headband.

* * * * *